United States Patent [19]

Duda

[11] 4,345,793

[45] Aug. 24, 1982

[54] FURNITURE FOR CONVERTING A CHAIR OR SETTEE INTO A LOUNGE

[76] Inventor: Henry J. Duda, 3357 N. Newland, Chicago, Ill. 60634

[21] Appl. No.: 149,030

[22] Filed: May 12, 1980

[51] Int. Cl.[3] ..... A47C 7/52; A47C 9/00

[52] U.S. Cl. ..... 297/438; 297/441

[58] Field of Search ..... 297/31, 226, 438, 441

[56] References Cited

U.S. PATENT DOCUMENTS

| | | | |
|---|---|---|---|
| 2,020,207 | 11/1935 | Platter | 297/438 X |
| 2,051,254 | 8/1936 | Haberstump | 297/438 X |
| 2,600,374 | 6/1952 | O'Neill | 297/31 |
| 2,664,148 | 12/1953 | Rechler | 297/438 |

FOREIGN PATENT DOCUMENTS

| | | | |
|---|---|---|---|
| 598275 | 6/1934 | Fed. Rep. of Germany | 297/438 |
| 470477 | 8/1937 | United Kingdom | 297/438 |
| 783026 | 9/1957 | United Kingdom | 297/438 |
| 1020687 | 2/1966 | United Kingdom | 297/441 |
| 1101716 | 1/1968 | United Kingdom | 297/441 |

*Primary Examiner*—Robert Mackey

*Attorney, Agent, or Firm*—Dithmar, Stotland, Stratman & Levy

[57] ABSTRACT

An add-on piece of furniture for converting a chair or settee into a chaise lounge. The add-on furniture includes a generally rectangular frame with a forward pivotally mounted leg assembly. At the rear end of the rectangular frame is a pair of spaced apart hooks resiliently connected to the frame and in position to hook onto an associated chair or settee converting same into a chaise lounge.

6 Claims, 5 Drawing Figures

FIG. 1
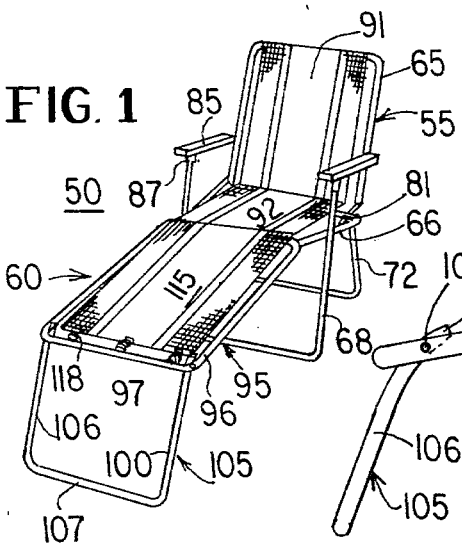
FIG. 2
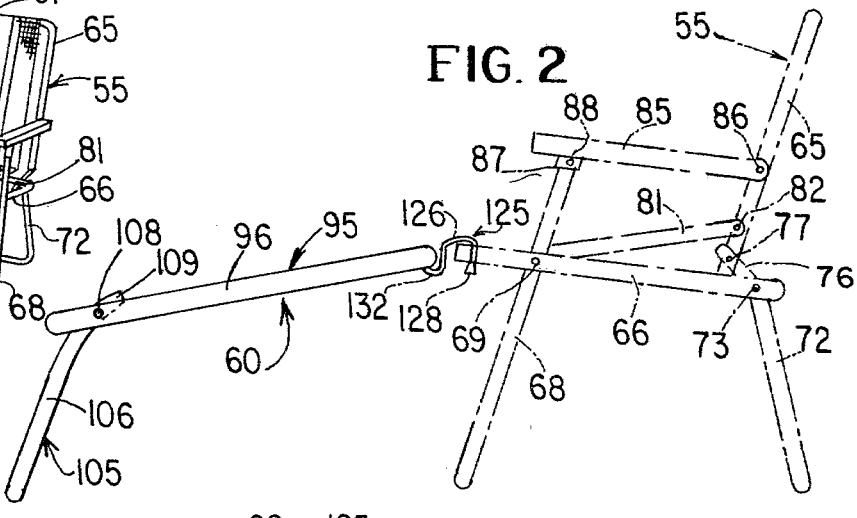
FIG. 3
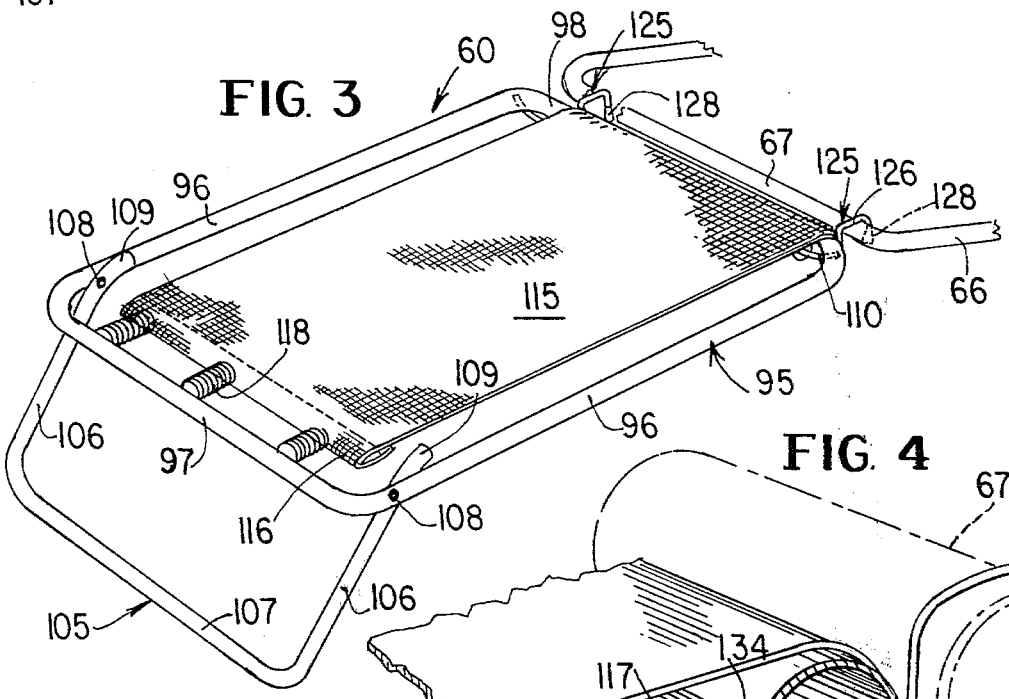
FIG. 4
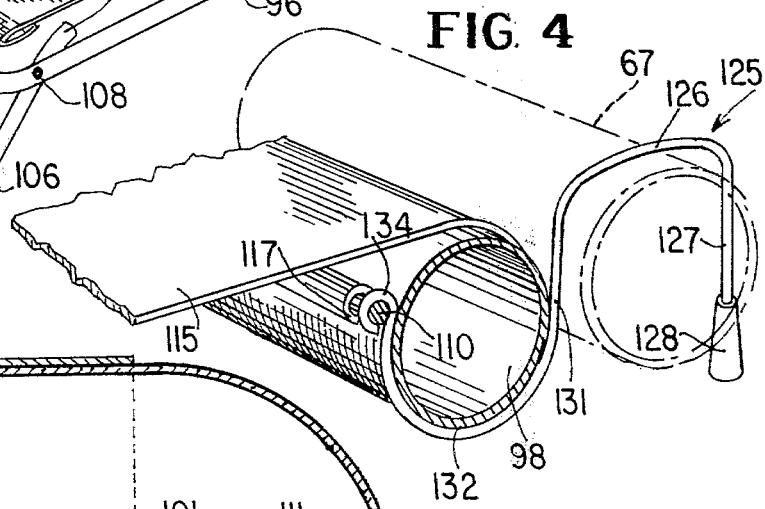
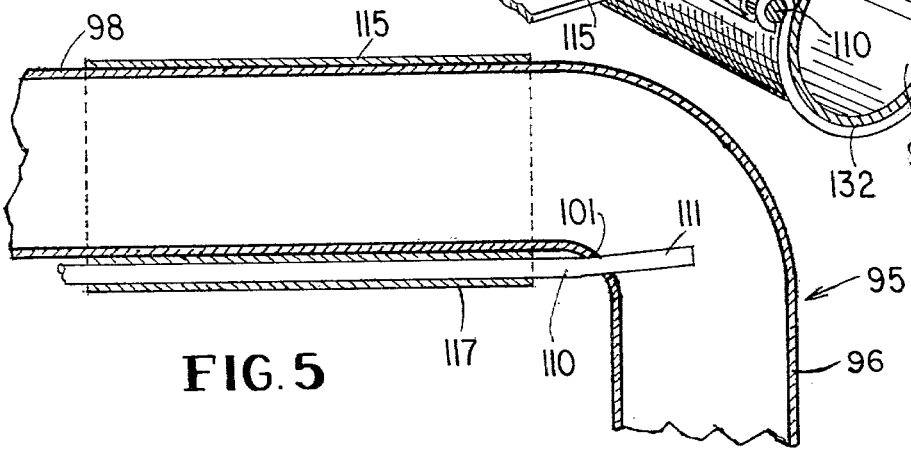
FIG. 5

FURNITURE FOR CONVERTING A CHAIR OR SETTEE INTO A LOUNGE

BACKGROUND OF THE DISCLOSURE

Folding furniture is generally of the portable type, that is easily foldable for storage and generally light weight. Particularly, in the recreational vehicle industry it is advisable and useful to provide light weight furniture such as arm chairs, settees and chaise lounges. Because of space restrictions, chaise lounges, although desirable and comfortable, often take up too much room. In addition, chaise lounges are often uncomfortable for normal sitting and are not capable of functioning alternately as a chair, but rather, are only adapted to stretching out in a semi-reclined or fully reclined position.

It would be highly desirable, but currently unavailable, to find some means for converting the usual fold up arm chair or settee into a chaise lounge. This is desirable from the point of view of allowing the normal arm chair or settee to function as such when desirable but being capable of conversion to a chaise lounge when that form is preferable. To date, there is not available mechanism for effecting the conversion of a normal fold up arm chair or settee to a chaise lounge.

SUMMARY OF THE INVENTION

This invention relates to a piece of furniture particularly useful for converting an arm chair or settee into a chaise lounge. More particularly, this invention relates to a piece of furniture for converting a fold up lawn chair into a chaise lounge.

The principal object of the present invention is to provide a piece of furniture which in and of itself folds up for easy and compact storage which can convert a normal arm chair or settee into a chaise lounge.

Another object of the present invention is to provide furniture for converting a chair or a settee into a chaise lounge, the furniture comprising a generally rectangular frame, a leg assembly pivotally mounted to one end of the rectangular frame moveable between a storage position wherein the leg assembly is adjacent the rectangular frame and substantially parallel thereto and a support position wherein the leg assembly extends away from and is supportive of the rectangular frame, means at the other end of the rectangular frame for removable connection to the associated chair or settee, and fabric mounted to the rectangular frame providing a lounge surface.

A further object of the present invention is to provide a piece of furniture of the type set forth including a generally rectangular frame, a leg assembly pivotally mounted to one end of the rectangular frame movable between a storage position wherein the leg assembly is adjacent the rectangular frame and substantially parallel thereto and a support position wherein the leg assembly extends away from and is supportive of the rectangular frame, a rod positioned parallel and adjacent to the other end of the frame and resiliently mounted thereto, spaced apart hooks each having one end thereof mounted on the rod and the other end thereof extending outwardly and away from the other end of the rectangular frame for removable connection to the associated chair or settee, and fabric connected to the one end of the rectangular frame and to the rod.

A still further object of the present invention is to provide furniture of the type set forth in which the hooks each have an arcuate portion thereof passing underneath the associated rectangular frame and over and around the rod and in use pass over the associated chair or settee frame member and extend downwardly therebeyond.

Yet another object of the present invention is to provide furniture of the type set forth wherein the fabric is resiliently mounted to the rectangular frame.

These and other objects of the present invention may more readily be understood when taken in connection with the following specification and drawings, in which:

BRIEF DESCRIPTION OF THE DRAWINGS

FIG. 1 is a perspective view of a fold away arm chair and add-on furniture of the present invention connected to form a chaise lounge;

FIG. 2 is an enlarged side elevational view showing the add-on furniture of the present invention in the operative position thereof and an associated arm chair in phantom;

FIG. 3 is an enlarged perspective view of the add-on furniture of the present invention showing the connection thereto to an associated chair frame;

FIG. 4 is an enlarged fragmentary perspective view illustrating the connection of the fabric to the add-on furniture frame and the connection means for the associated chain frame member; and FIG. 5 is an enlarged fragmentary view partly in section of the end of the rectangular frame showing the resilient mounting of the fabric to the frame member.

DESCRIPTION OF THE PREFERRED EMBODIMENT

Referring now to the drawings, there is disclosed a chaise lounge 50 comprised of a folding chair 55 and a furniture add-on 60. Although a chair is illustrated, it is contemplated that the invention likewise is useful with a settee and although a folding chair is illustrated, it is contemplated that the invention is also useful with non-folding furniture. The folding chair 55 includes a generally rectangular tubular back frame 65 connected to a generally rectangular tubular seat frame 66 having a front piece 67. Both the tubular back frame 65 as well as the tubular seat frame 66, as illustrated, are circular in transverse cross-section and are hollow. A U-shaped front leg assembly 68 is pivotally connected to the tubular seat frame 66 by rivets 69, one such rivet 69 being provided for each of the upstanding leg portions of the front leg assembly 68. A U-shaped rear leg assembly 72 is pivotally connected to the tubular seat frame 66 by rivets 73, one such rivet 73 being provided for each of the upstanding legs of the rear leg assembly 72. Each of the legs of the rear leg assembly has a forwardly extending, angularly disposed extension 76, each of which is pivotally connected by a rivet 77 to the associated portion of the tubular back frame 65. Both the front leg assembly 68 and the rear leg assembly 72 are generally U-shaped with the upstanding legs being pivotally connected to the associated one of the tubular back frame 65 and the tubular seat frame 66. Finally, each of two parallel braces 81 is pivotally mounted to the associated portion of the back frame 65 by a rivet 82 and also pivotally mounted to the tubular seat frame 66 at the rivet 69, thereby to complete the connection of the back frame 65 and the seat frame 66.

The chair 55 also includes two arm rests 85, each pivotally connected by means of a rivet 86 to the associated portion of the tubular back frame 65 and each having adjacent the forward free end thereof spaced-apart downwardly extending mounting tabs 87. The mounting tabs 87 are apertured and received therebetween the terminal portion of the front leg assembly 68 with each pair of mounting tabs 87 being pivotally connected to the front leg assembly by means of a rivet 88.

Finally, fabric or other suitable material 91 extends over the tubular back frame 65 and fabric or other suitable material 92 extends over the tubular seat frame 66, both of the fabric pieces 91 and 92 being suitably connected respectively, to the back frame 65 and the seat frame 66 by means not shown.

The add-on furniture 60 includes a generally rectangular tubular frame 95 comprised of generally parallel spaced-apart side members 96 interconnected by a front member 97 and a rear member 98, the entire frame 95 being one piece and, as shown, circular in transverse cross-section. Apertures 101 are provided adjacent the junctures between the sides 96 and the rear member 98, the apertures 101 being in the rear member 98, particularly see FIG. 5. A leg assembly 105 is generally U-shaped and has spaced-apart legs 106 interconnected by a bight 107, each of the legs 106 at the free ends 109 thereof being pivotally mounted to the adjacent side 96 of the frame 95 by a rivet 108. The free end 109 of each leg 106 is angularly disposed with respect to the rest of the leg 106 and serves to provide a support surface for the frame 95 and particularly the front member 97 thereof when the leg assembly 105 is pivoted to the support position, as illustrated in the drawings. The leg assembly 105 is movable about the rivets 108 from the support position illustrated, wherein the frame 95 rests on the leg assembly 105, and more particularly the front member 97 rests on the bends between the free ends 109 and the legs 106 and a storage position in which the leg assembly 105 is pivoted about the rivets 108 such that the leg assembly lies adjacent and substantially parallel to the frame 95.

At the end of frame 95 opposite to the front member 97 is a rod 110 having the free ends thereof 111 bent at an angle of approximately 5° to the longitudinal axis of the rod 110, the rod being of a size to fit within the apertures 101 in the rear frame member 98 of the frame 95. The rod 110 is therefore resiliently mounted to the frame 95, for a purpose hereinafter set forth. Fabric or other suitable material 115 is provided with a sleeve 116 at the end thereof adjacent the front member 97 and has a sleeve 117 at the other end thereof. Coil springs 118 serve to connect the fabric 115 to the front member 97 of the frame 95. The other end of the fabric 115 passes around the rear member 98 of the frame 95 and is connected to the frame by means of the rod 110 which passes through the sleeve 117. The fabric 115 is thus resiliently mounted to the frame 95 to permit use as a chaise lounge or ottoman.

Connection means 125 serve to interconnect the add-on furniture 60 to the chair 55 to form the chaise lounge 50. Each of the connection means 125 has an engagement hook 126 having a downardly extending leg 127 terminating in a protective tip 128. The length of the leg 127 is such that in use it extends downwardly and below the front piece 67 of the tubular seat frame 66. Each of the connection means 125 further includes a leg 131 generally parallel to the leg 127 which fits between the front piece 67 of the chair 55 and the rear frame member 98 of the add-on furniture 60, the leg 131 being integrally formed with the hook 126, the leg 127 and an arcuate support member 132 which passes underneath the frame 98 and terminates in an attachment eye 134 that wraps around the rod 110, thereby to provide secure connection by the connection means 125 of the frame 95 and the tubular seat frame 66 of the chair 55.

The add-on furniture 60 may be used with any suitable chair 55 or settee, not illustrated, to convert same into a chaise lounge 50. The advantage of the present invention is that the chair 55 or settee may be the usual folding type and may function as a chair or settee until it is desired to convert same into a chaise lounge. At which time, the add-on furniture 60 which is conveniently and compactly stored due to the pivoting connection of the front leg assembly 105 to the frame 95 may be easily attached to the desired chair 55 or settee to convert same to a chaise lounge 50. In this manner, an ordinary fold up chair 55 or settee may serve a dual function, which is particularly useful where space is limited as in the recreational vehicle field including campers, trailers and the like.

While there has been provided what at present is considered to be the preferred embodiment of the present invention, it will be understood that various modifications and alterations may be made therein without departing from the true spirit and scope of the present invention, and it is intended to cover in the claims appended hereto all such modifications and variations.

I claim:

1. Furniture for converting a chair or settee into a lounge, said furniture comprising a generally rectangular frame, a leg assembly pivotally mounted to one end of said rectangular frame movable between a storage position wherein said leg assembly is adjacent said rectangular frame and substantially parallel thereto and a support position wherein said leg assembly extends away from and is supportive of said rectangular frame, a rod positioned parallel and adjacent to the other end of said frame and resiliently mounted thereto, spaced apart hooks each having one end thereof mounted on said rod and the other end thereof extending outwardly and away from the other end of said rectangular frame for removable connection to the associated chair or settee, said hooks each having an arcuate portion thereof passing underneath the associated rectangular frame and over and around said rod and in use pass over the associated chair or settee frame member and extend downwardly therebeyond and fabric connected to said one end of said rectangular frame passing over and around the other end of said frame for connection to said rod, whereby to maintain tension on said rod to maintain said rod in place when said furniture is connected to a chair or settee.

2. The furniture of claim 1, wherein the other end of said rectangular frame has spaced apart apertures therein and the free ends of said rod are mounted in said apertures and maintained therein by spring action of said rod.

3. The furniture of claim 1, wherein said rod is resiliently mounted in two spaced apart apertures in the other end of said frame, the free ends of said rod forming an angle of about 5° with the axis of the other end of said frame.

4. The furniture of claim 1, wherein said fabric is mounted by coil springs to said one end of said rectangular frame and wrapped around said rod to provide resilient mounting of said fabric to said frame.

5. The furniture of claim 4, wherein a sleeve is formed at the end of said fabric wrapped around said rod and said rod fits within said sleeve.

6. The furniture of claim 4, wherein said one end of each of said hooks is wrapped around said rod near the fabric edges.

* * * * *